United States Patent [19]

Amici et al.

[11] Patent Number: 4,990,119

[45] Date of Patent: Feb. 5, 1991

[54] SIMULATED NURSING BOTTLE FOR DOLL

[75] Inventors: Francis R. Amici, Northford, Conn.; Brian Fontaine, Southbridge, Mass.; Craig Dubois, Granby, Conn.

[73] Assignee: Hasbro, Inc., Pawtucket, R.I.

[21] Appl. No.: 385,288

[22] Filed: Jul. 26, 1989

[51] Int. Cl.[5] ..... A63H 3/52

[52] U.S. Cl. ..... 446/267; 446/188

[58] Field of Search ..... 446/71, 73, 74, 76, 446/81, 166, 213, 267, 404, 483, 486, 487, 188; 272/8 N, 8 R

[56] References Cited

U.S. PATENT DOCUMENTS

| | | | |
|---|---|---|---|
| 1,616,845 | 2/1927 | Denivelle | 446/267 |
| 1,692,938 | 2/1927 | Jacobs . | |
| 2,039,373 | 5/1936 | Wittmann . | |
| 2,996,831 | 8/1961 | Woron | 446/267 X |
| 3,061,970 | 11/1962 | Knott | 446/267 X |
| 3,071,888 | 1/1963 | Knott . | |
| 3,105,324 | 10/1963 | Friedman . | |
| 3,105,325 | 10/1963 | Gardel et al. . | |
| 3,237,340 | 3/1966 | Knott | 446/267 |
| 3,245,174 | 4/1966 | Gardel et al. . | |
| 3,729,859 | 5/1973 | Smith, III et al. . | |
| 4,186,513 | 2/1980 | Blum . | |

FOREIGN PATENT DOCUMENTS

| | | | |
|---|---|---|---|
| 2415475 | 9/1979 | France | 446/267 |

*Primary Examiner*—Mickey Yu

[57] ABSTRACT

A simulated baby-nursing bottle has spaced inner and outer cylindrical shells providing a narrow annular cavity therebetween in which is disposed a colored liquid. The cap provides a concealed chamber into which the liquid may drain when the bottle is tipped downwardly. The simulated nipple includes an axially reciprocatable portion which acts upon a compressible member communicating with a clear liquid within the inner shell to produce air bubbles and agitation of the liquid within the container when the reciprocatable portion is depressed. In one embodiment, a second compressible member is provided in the bottom of the inner shell which is vented to the atmosphere and which is compressed to expel air therefrom when the first compressible member is compressed by the nipple portion.

20 Claims, 3 Drawing Sheets

SIMULATED NURSING BOTTLE FOR DOLL

BACKGROUND OF THE INVENTION

The present invention relates to simulated baby nursing bottles for use with dolls and the like.

For a number of years, some simulated nursing bottles for dolls have been made with a inner and outer shells providing a relatively narrow annular chamber therebetween in which is disposed a colored liquid simulating milk. The nipple and/or the cap of the toy nursing bottle is opaque and there is provided a restricted flow path from the annular spacing between the shells into the cap or nipple. As a result, tipping the bottle downwardly produces a slow drainage of the colored liquid into the cap or nipple to make it appear that the doll is drinking the contents.

Because so little liquid is flowing from the annular spacing into the cap, there is little opportunity to add any realism to the action which is taking place. However, it has been proposed to add sound elements to the nursing bottle in an effort to heighten the play action.

It is an object of the present invention to provide a novel simulated baby nursing bottle in which there is apparent agitation of a liquid in the nursing bottle.

It is also an object to provide such a nursing bottle which may be fabricated and assembled readily from components which may be fabricated relatively economically.

Another object is to provide such a nursing bottle which will exhibit reasonably long life while providing enhanced play action.

Still another object of the present invention is to provide such a toy nursing bottle in which there is provided means for generation of a slurping sound.

SUMMARY OF THE INVENTION

It has now been found that the foregoing and related objects may be readily attained in a simulated nursing bottle for dolls which has an outer shell having the appearance of a baby nursing bottle with an elongated sidewall. A cap is on the upper end of the outer shell, and a simulated nipple is mounted in the cap and has at least a portion reciprocatable axially inwardly relative to the outer shell and cap.

An inner container is disposed within the shell and has an elongated sidewall spaced from, but closely adjacent, the sidewall of the outer shell to provide a narrow annular cavity therebetween. There are provided means sealing the annular cavity adjacent the base of the sidewalls, and means providing a closure for the upper end of the inner container and an air passage thereinto. There is also means providing a closed chamber communicating with the upper end of the annular cavity and substantially concealed by the cap.

A resiliently compressible member provides an air chamber above the inner container and this chamber communicates with the air passage into the inner container. The reciprocatable nipple portion is operative to compress this member when reciprocated axially and thereby causes air to flow into the inner chamber.

Colored liquid is disposed in the annular cavity and clear liquid is disposed in the inner container. When the bottle is tipped downwardly, the colored liquid in the annular cavity slowly drains into the closed chamber and is concealed therein, and reciprocation of the nipple portion causes the clear liquid in the inner container to be agitated.

In one embodiment, a second resiliently compressible member is provided in the bottom of the inner container, and the bottom of the bottle has a vent therethrough from the second compressible member. When the first mentioned compressible member is compressed by the movement of the nipple portion, the second compressible member is compressed and air is expelled therefrom through the vent.

Preferably, the nipple includes a fixed peripheral element with a central bore, and a reciprocatable element is slidably seated in the central bore of the element and has a portion of nipple-like configuration extending outwardly of the fixed element.

The compressible member is desirably a bellows having at its lower end an opening communicating with the air passage into the inner container, and the reciprocatable element acts upon the upper end of the bellows.

Preferably, the inner container has a top wall in part providing the closure therefor, and the top wall has an aperture therein in part providing the air passage thereinto. At the upper end of the outer shell is an inwardly extending inverted, generally U-shaped spacer abutting the top wall of the inner container to partially define the closed chamber, and the inner container has an upstanding boss providing an annular channel seating the inner leg of the spacer.

Preferably, the top wall of the inner container has an upstanding circular boss about the aperture therein and an insert member is seated in this aperture. The compressible member has its lower end portion engaged between the insert member and the circular boss.

In its usual form, the bottle has a bottom closure with a base wall providing recesses seating the lower ends of the sidewalls of the inner container and outer shell to provide the sealing means for the annular cavity.

DETAILED DESCRIPTION OF PREFERRED EMBODIMENT OF THE INVENTION

Figure 1:
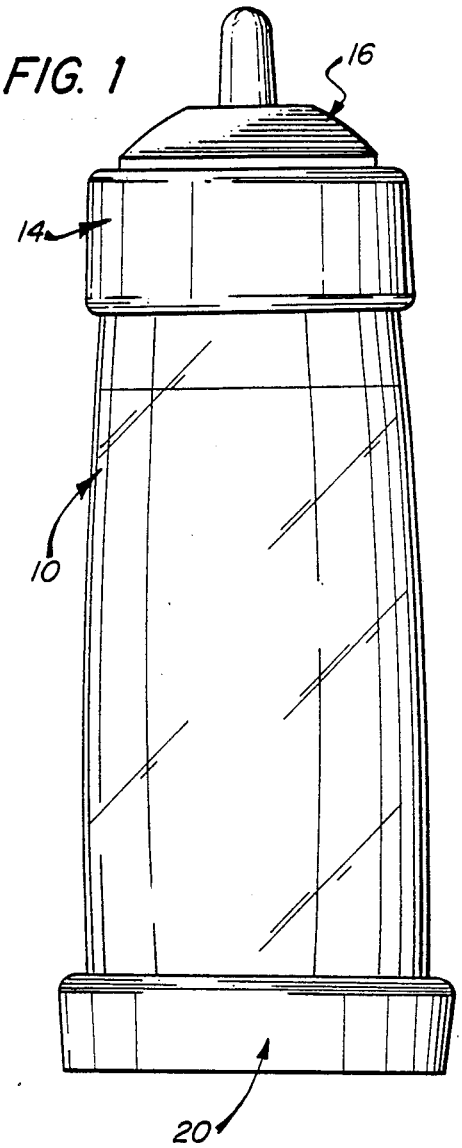
FIG. 1 is a side elevational view of a simulated baby nursing bottle embodying the present invention.

As seen in the attached drawings, a simulated baby nursing bottle embodying the present invention is comprised of an outer shell generally designated by the numeral 10, an inner shell or container generally designated by the numeral 12, a top cap generally designated by the numeral 14 and seating the simulated nipple generally designated by the numeral 16, a compressible bellows member generally designated by the numeral 18, and a bottom closure generally designated by the numeral 20. Disposed in the narrow annular space 23 between the sidewall 22 of the inner shell 12 and the sidewall 24 of the outer shell 10 is a volume of colored liquid 26, and disposed within the inner shell 12 is a volume of clear liquid 28.

Turning first in detail to the outer shell 10, it has an elongated cylindrical sidewall 24 and is open at its bottom end. Bonded to the top end of the sidewall 24 is an upwardly and inwardly extending spacer generally designated by the numeral 30 and of inverted generally U-shaped configuration providing an annular cavity or chamber between its inner leg 31 and outer leg 29.

The inner shell 12 also has an elongated sidewall 22 and is open at its bottom end. It has a top wall 32 which has a coaxial aperture 34 therethrough and about which is an upstanding cylindrical collar 36. Spaced outwardly from the collar 36 is an upstanding circular wall 38 providing an annular recess 40 in which is seated the lower end of the inner leg 31 of the spacer 30.

Seated between the inner and outer walls 29, 31 of the spacer 30 is a baffle member 42 having axial apertures 44 extending therethrough, and it cooperates with the walls 29, 31 of the spacer 30 to define a chamber 46 which communicates with the axial space 23 between the sidewalls 22, 24 to receive and conceal the liquid 26 which drains thereinto when the bottle is tipped downwardly.

The bottom closure 20 has a transverse wall 90 and a peripheral wall 50. A boss formed inwardly of the upper portion of the peripheral wall 50 provides a pair of annular channels 52, 54 which seat the lower ends of the sidewalls 22, 24.

The nipple 16 has a dome-shaped peripheral element 56 with a outwardly extending flange 58 about its lower end which is captured between the inwardly extending flange 60 at the upper end of the cap 14 and the upper end of the spacer 30. In the center of the top of the nipple 16 is a recessed portion 62 which has a coaxial passage 64 of circular cross section extending therethrough. Slidably seated in the passage 64 is a reciprocatable element 66 which has an upper portion 68 having a configuration simulating a nipple, and its lower portion is provided with an outwardly offset flange 69 engageable against the inner end of the wall of the peripheral element 56 defining the passage 64.

The upper portion 70 of the bellows 18 seats within the lower portion of the reciprocatable element 66 and the body portion thereof extends in the space defined by the inner wall 31 of the spacer 30. The bottom wall of the bellows 18 is formed with a depending coaxial neck portion 72 which extends into the aperture 34. A plug 74 has a base portion 76 which bears against the recessed top wall 32 and an upstanding cylindrical boss 78 which extends into the aperture 34, thus firmly engaging the neck portion 72 therebetween. As seen, the plug 74 has a bore 80 extending therethrough to provide a conduit from the chamber within the bellows 18 to the chamber within the inner shell 12.

Disposed in the inner shell 12 is a second bellows member generally designated by the numeral 82, with a body portion 84 and a depending neck portion 86 which extends into an aperture 88 in the transverse wall 90 of the bottom closure 20. Surrounding the aperture 88 is an upstanding collar 92. A plug member 94 has a base portion 96 and an upstanding cylindrical portion 98 which extends through the transverse wall 90 and into the neck portion 86 to capture it. As seen, the bottom surface of the transverse wall 90 has a circular boss 100 in which the base portion 96 is seated. Extending through the plug member 94 is a vent passage 102.

Figure 2:
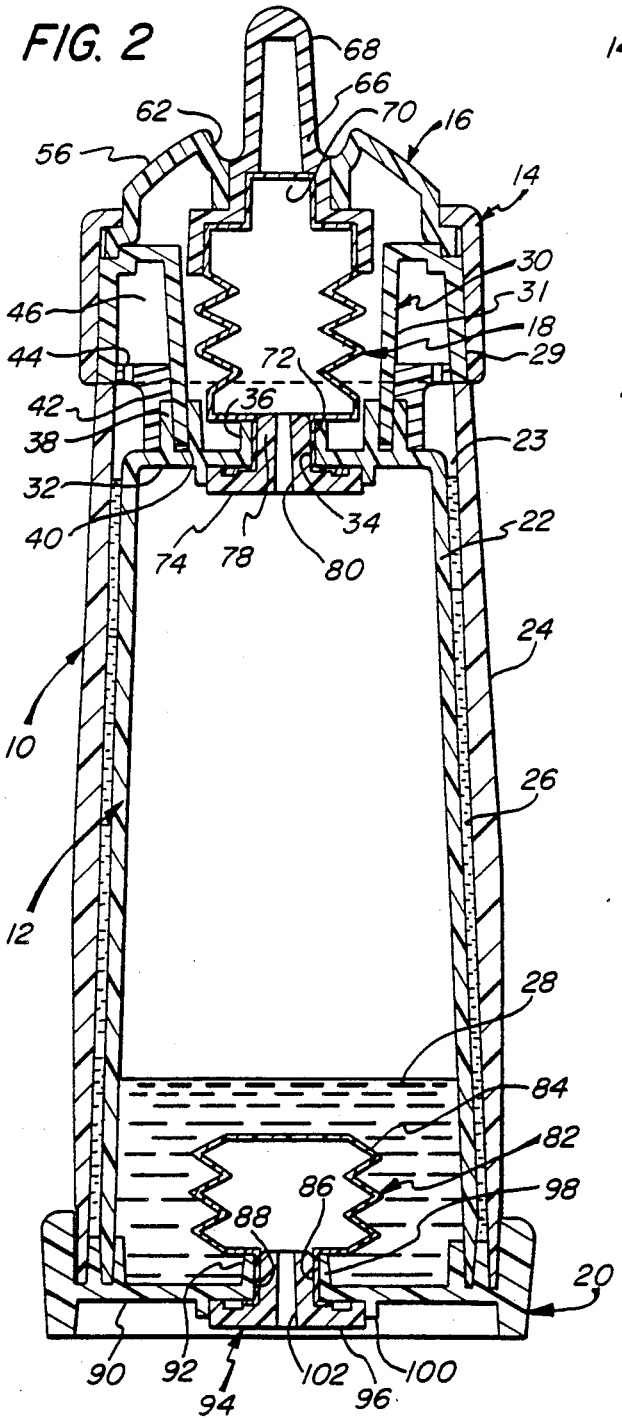
FIG. 2 is a sectional view thereof drawn to a slightly enlarged scale.
Figure 3:
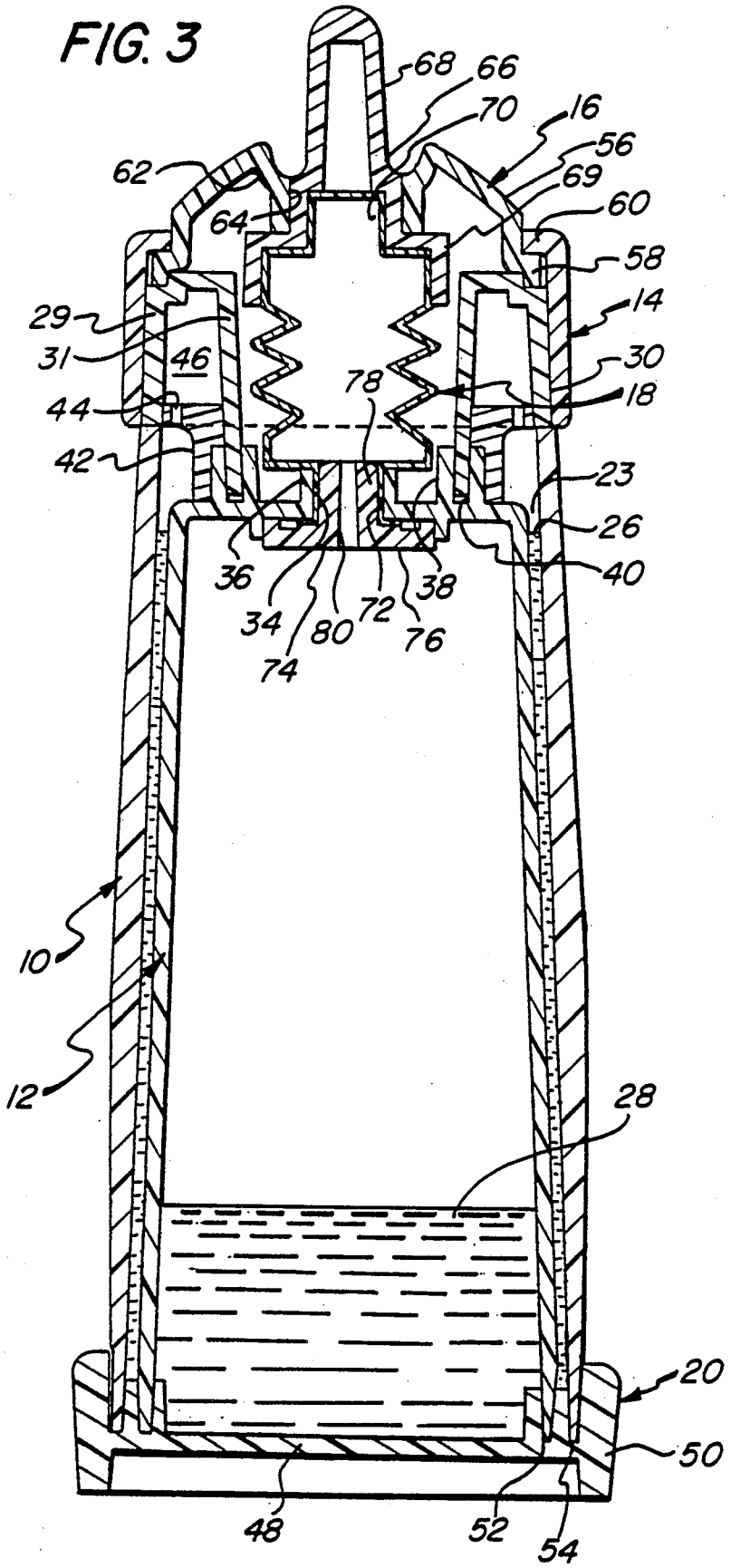
FIG. 3 is a sectional view of another embodiment of the bottle of the present invention.

Turning now to the embodiment of FIG. 3, the bottle illustrated therein is essentially the same as that in FIG. 2 with the exception of the deletion of the second bellows member 82 and the transverse wall 48 is imperforated.

Figure 4:
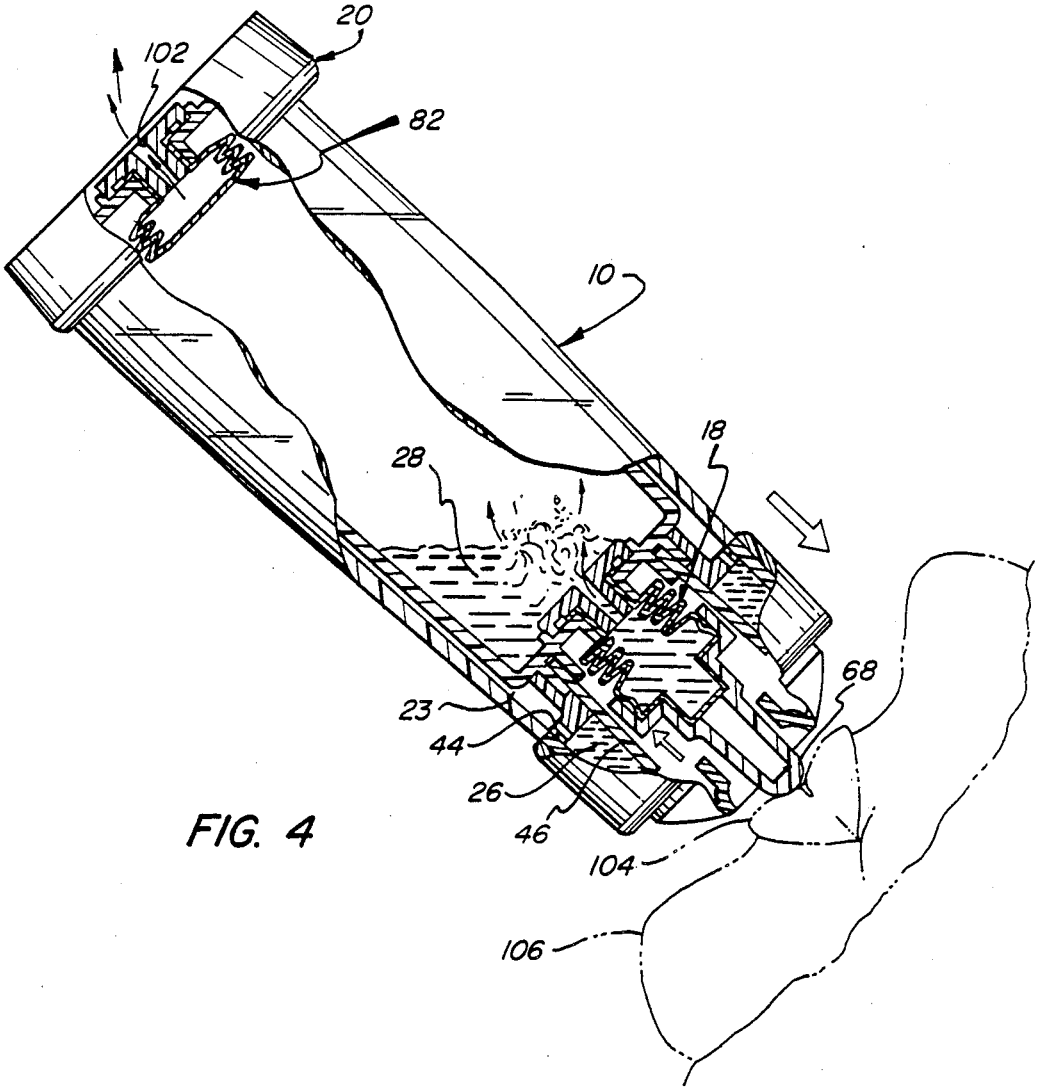
FIG. 4 is a sectional view of the bottle embodiment of FIG. 2 tipped downwardly and with the nipple being pushed inwardly by a doll fragmentarily illustrated in phantom line to cause air to flow into and agitate the liquid in the inner container.

Turning now to FIG. 4, the operation of the bottle of the present invention is diagrammatically illustrated therein. As seen, the bottle has been tipped downwardly and the nipple 16 has been placed against the lips 104 of the doll 106 with sufficient pressure so as to cause the reciprocatable nipple element 66 to be moved axially inwardly compressing the bellows 18 and causing air to flow outwardly from the bellows 18 through the passage 80 and into the interior of the inner shell 12 causing turbulence within the clear liquid 28.

In this embodiment, the increase in pressure within the interior of the inner shell 12 effects compression of the second bellows 82 causing air to flow outwardly through the passage 102 and the result is a sound which simulates the slurping of a baby while sucking on the nipple of a bottle. Concurrently, the colored liquid 26 is moving downwardly through the apertures 44 in the baffle 42 into the chamber 46 so that it appears that the contents of the bottle are being drunk by the doll 106.

Upon release of the pressure on the nipple element 66, liquid will flow into the bellows 18 to replace the air which has been expelled, and the subsequent compression of the bellows will then force liquid outwardly to produce the agitation.

As will be appreciated, release of the pressure against the bellows 18 will allow the bellows 82 to recover and draw air inwardly. It too will again be compressed upon reciprocation of the nipple element 66 inwardly of the bottle.

To effectuate the purpose of the present invention, the material from which the outer shell 10 is fabricated should be reasonably transparent to allow the colored liquid to be seen and its level in the annular space 23 to be observed. The material from which the inner shell 12 is fabricated should be translucent so that the turbulence induced by the expulsion of air or liquid from the bellows 18 can be observed without observation of any difference in the level of the liquids within the shell 12 and in the space 23.

To this end, various resins may be employed including polyethylene, rubber-modified styrenes and acrylics, and polyvinyl chloride.

To provide the resiliently compressible bellows members, the material employed must have elastomeric properties. Among the materials which may be employed are ethylene vinyl acetate butadiene/styrene, butadiene/acrylate, and butadiene/acryionitrile copolymers. The nipple, cap and other non-resilient elements of the assembly may be fabricated from any suitable resin including the polyethlyene, polypropylene, impact polystyrene, ABS and polyvinyl chloride.

By fabricating the several components as illustrated in the drawings, the bottle may be readily assembled and the components sonically welded or otherwise adhered to provide a leak-proof durable structure. The various components may be bonded together by sonic welding or like techniques to effect adhesion of the components, and it will be seen that the design of the components provides excellent surface areas such sonic welding techniques.

Thus, it can be seen from the foregoing details specifications and drawings that the simulated baby nursing bottle of the present invention is one which provides unique play action in the simulation of liquid movement which would occur in a real nursing bottle and also in providing sound in one of the embodiments. The components may be fabricated readily and assembled relatively economically to provide a long lived structure.

Having thus described the invention, what is claimed is:

1. A simulated nursing bottle for dolls comprising:
(a) an outer shell having the appearance of a baby nursing bottle, said outer shell having an elongated sidewall;
(b) a cap on said upper end of said outer shell;
(c) a simulated nipple mounted in said cap and having at least a portion reciprocatable axially inwardly relative to said outer shell;
(d) an inner container having an elongated sidewall spaced from, but closely adjacent, said sidewall of said outer shell to provide a narrow annular cavity therebetween;
(e) means sealing said annular cavity adjacent the base of said sidewalls;
(f) closure means on the upper end of said inner container and providing an air passage therethrough to said inner container;
(g) means within said cap providing a chamber communicating with the upper end of said annular cavity, said chamber being substantially concealed by said cap;
(h) a resiliently compressible member providing an air chamber above said inner container communicating with said air passage into said inner container, said reciprocatable nipple portion being operative to compress said member when reciprocated axially and thereby to cause air to flow into said inner chamber;
(i) colored liquid in said annular cavity; and
(j) clear liquid in said inner container, whereby, when said bottle is tipped downwardly, the colored liquid in said annular cavity slowly drains into said closed chamber and is concealed therein and reciprocation of said nipple portion causes said clear liquid in said inner container to be agitated.

2. The simulated nursing bottle in accordance with claim 1 wherein said nursing bottle includes a second resiliently compressible member in the bottom of said inner container, and the bottom of said bottle has a vent therethrough from said compressible member, said second compressible member being compressed when said nipple portion is moved inwardly to compress said first mentioned compressible member.

3. The simulated nursing bottle in accordance with claim 2 wherein said second compressible member is a bellows.

4. The simulated nursing bottle in accordance with claim 1 wherein said simulated nipple includes a fixed peripheral element with a central bore and a reciprocatable element slidably seated in said central bore of said element and having a portion of nipple-like configuration extending outwardly of said fixed element and providing said reciprocatable portion of simulated nipple.

5. The simulated nursing bottle in accordance with claim 1 wherein said compressible member is a bellows having at its lower end an opening communicating with said air passage into said inner container.

6. The simulated nursing bottle in accordance with claim 4 wherein said compressible member is a bellows having at its lower end an opening communicating with said air passage into said inner container and said reciprocatable element acts upon the upper end of said bellows.

7. The simulated nursing bottle in accordance with claim 1 wherein said inner container has a top wall with an aperture therein.

8. The simulated nursing bottle in accordance with claim 7 wherein said outer shell has an inwardly extending inverted, generally U-shaped spacer at its upper end abutting said top wall of said inner container to partially define said closed chamber.

9. The simulated nursing bottle in accordance with claim 8 wherein said inner container has an upstanding boss providing an annular channel seating said the inner leg of said spacer.

10. The simulated nursing bottle in accordance with claim 7 wherein said top wall of said inner container has an upstanding circular boss about said aperture therein, wherein there is included an insert member seated in said aperture, and wherein said compressible member has its lower end portion engaged between said insert member and said circular boss.

11. The simulated nursing bottle in accordance with claim 10 wherein said compressible member is a bellows having at its lower end an opening communicating with said air passage into said inner container.

12. The simulated nursing bottle in accordance with claim 1 wherein said bottle has a bottom closure having a base wall with recesses seating the lower ends of said sidewalls of said inner container and outer shell to provide said sealing means for the annular cavity.

13. A simulated nursing bottle for dolls comprising:
(a) an outer shell having the appearance of a baby nursing bottle, said outer shell having an elongated sidewall and an opening at its upper end;
(b) a cap closing said upper end of said outer shell;
(c) a simulated nipple mounted in said cap, said nipple having a fixed peripheral element with a central bore and an axially reciprocatable element slidably seated in said central bore of said element with a portion of nipple-like configuration extending outwardly of said fixed element;
(d) an inner container having an elongated sidewall spaced from, but closely adjacent, said sidewall of said outer shell to provide a narrow annular cavity therebetween;
(e) a bottom closure having a base wall with recesses seating the lower ends of said sidewalls of said inner container and outer shell to seal the lower end of said annular cavity;
(f) closure means on the upper end of said inner container and providing an air passage therethrough to said inner container;
(g) means within said cap providing a chamber communicating with the upper end of said annular cavity, said chamber being substantially concealed by said cap;
(h) a resiliently compressible member providing an air chamber above said inner container communicating with said air passage into said inner container, said reciprocatable nipple portion being operative to compress said member when reciprocated axially and thereby to cause air to flow into said inner chamber;
(i) colored liquid in said annular cavity; and
(j) clear liquid in said inner container, whereby, when said bottle is tipped downwardly, the colored liquid in said annular cavity slowly drains into said closed chamber and is concealed therein and reciprocation of said nipple portion causes said clear liquid in said inner container to be agitated.

14. The simulated nursing bottle in accordance with claim 13 wherein said compressible member is a bellows having at its lower end an opening communicating with said air passage into said inner container and said reciprocatable element acts upon the upper end of said bellows.

15. The simulated nursing bottle in accordance with claim 13 wherein said inner container also has a top wall with an aperture therein.

16. The simulated nursing bottle in accordance with claim 15 wherein said outer shell has an inwardly extending inverted, generally U-shaped spacer at its upper end with its inner leg abutting said top wall of said inner container to partially define said closed chamber.

17. The simulated nursing bottle in accordance with claim 16 wherein said inner container has an upstanding boss providing an annular channel seating said inner leg.

18. The simulated nursing bottle in accordance with claim 16 wherein said top wall of said inner container has an upstanding circular boss about said aperture therein, wherein there is included an insert member seated in said aperture, and wherein said compressible member has its lower end portion engaged between said insert member and said circular boss.

19. The simulated nursing bottle in accordance with claim 13 wherein said nursing bottle includes a second resiliently compressible member in the bottom of said inner container, and the bottom of said bottle has a vent therethrough from said compressible member, said second compressible member being compressed when said nipple portion is moved inwardly to compress said first mentioned compressible member.

20. The simulated nursing bottle in accordance with claim 19 wherein said second compressible member is a bellows.

* * * * *